US006431979B1

(12) United States Patent
Asbjornson et al.

(10) Patent No.: US 6,431,979 B1
(45) Date of Patent: Aug. 13, 2002

(54) WALL CURB FOR HVAC SYSTEM

(75) Inventors: Norman J. Asbjornson, Tulsa; Richard J. Davis, Broken Arrow; Eric E. Braun, Tulsa, all of OK (US)

(73) Assignee: AAON, Inc., Tulsa, OK (US)

( * ) Notice: Subject to any disclaimer, the term of this patent is extended or adjusted under 35 U.S.C. 154(b) by 1 day.

(21) Appl. No.: 09/748,334

(22) Filed: Dec. 22, 2000

(51) Int. Cl.[7] ..... F24F 7/013

(52) U.S. Cl. ..... 454/233; 62/259.1; 62/427; 454/230; 454/236

(58) Field of Search ..... 62/259.1, 427, 62/DIG. 16; 454/230, 232, 233, 236; 52/60

(56) References Cited

U.S. PATENT DOCUMENTS 3,246,643 A * 4/1966 Stark et al.
4,315,415 A 2/1982 Wilson
4,403,481 A * 9/1983 Yoho, Sr. ..... 62/259.1
4,714,194 A 12/1987 Eckman
4,781,008 A 11/1988 Lyons, Jr.
4,843,839 A * 7/1989 Davis ..... 454/236 X
4,854,376 A 8/1989 Tunekawa et al.
4,895,066 A * 1/1990 Carnahan ..... 454/259.1 X
5,044,260 A 9/1991 Avari
6,041,557 A 3/2000 Brown et al.

* cited by examiner

*Primary Examiner*—Harold Joyce
(74) *Attorney, Agent, or Firm*—Molly D. McKay

(57) ABSTRACT

A wall curb 10 for attachment to the exterior wall 32 of a building to removably secure a wall mounted HVAC unit 38 to the exterior surface 44 of the wall 32. The wall curb 10 serves to attach the supply air duct 34 from within the building to the supply air opening of HVAC unit 38 and to attach the return air duct 36 from within the building to a return air opening of the HVAC 38. An alternate embodiment of the invention 10A includes an outside air opening 60 with a controllable damper 62 for regulating the ratio of outside air verses return air from the building that enters the HVAC unit 38.

6 Claims, 5 Drawing Sheets

WALL CURB FOR HVAC SYSTEM

BACKGROUND OF THE INVENTION

1. Field of the Invention

The present invention relates to a wall mounted curb that secures to the exterior of a wall so that both the supply duct and return air duct from the interior of the wall secure to the wall curb at corresponding openings that have been cut through the wall curb to align with and seal to the two ducts. A heating, ventilation, and air conditioning (hereafter referred to as HVAC) unit mounts to the wall curb on the exterior of the wall so that the supply air opening of the HVAC is aligned with and sealed to the supply air duct from the interior of the wall, and the return air opening of the HVAC is aligned with and sealed to the return air duct from the interior of the wall.

2. Description of the Related Art

Currently roof curbs are available that attach to the exterior surface of a roof of a building to attach a roof mounting HVAC unit to the roof. These roof curbs are located on the roof at a point on the roof to encompass the exits of the supply air duct of the building and the return air duct. Generally these roof curbs and their associated roof mounted HVAC units are used in large industrial or commercial buildings.

However, there are no wall curbs currently available for similarly mounting a wall mounted HVAC unit to an exterior wall of a building at the point where the supply air duct and return air duct exit the building. The present invention addresses this need by providing a wall curb for attachment to the exterior wall as a means of connecting the supply air duct and the return air duct from the interior of the building to the corresponding supply air opening and return air opening of a wall mounting HVAC located on the exterior of the building. The present invention also serves as a means of removably attaching the HVAC unit to the exterior of a building. Further, because the openings in the wall curb where the supply air duct and the return air duct attach to the wall curb are custom cut at the building site by installation personnel, a single type of wall curb will work with a wide range of sizes and shapes of supply air and return air ducts. The present invention come is two different styles, one without any outside air inlet and with an outside air inlet. The style of the present invention wall curb that has an outside air inlet is provided with a controllable damper for regulating the ratio of outside air verses return air form the building that enters the HVAC unit.

SUMMARY OF THE INVENTION

The present invention is a wall curb for attachment to the exterior wall of a building to removably secure a wall mounted HVAC unit to the exterior surface of the wall. The wall curb serves to attach the supply air duct from within the building to the supply air opening of HVAC unit and to attach the return air duct from within the building to a return air opening of the HVAC. Openings in the wall curb where the supply air duct and the return air duct attach to the wall curb are custom cut at the building site by installation personnel. One embodiment of the invention does not have any outside air inlet, and a second embodiment of the invention does have an outside air inlet with a controllable damper for regulating the ratio of outside air verses return air from the building that enters the HVAC unit.

DETAILED DESCRIPTION OF THE PREFERRED EMBODIMENT

THE INVENTION

Figure 1:
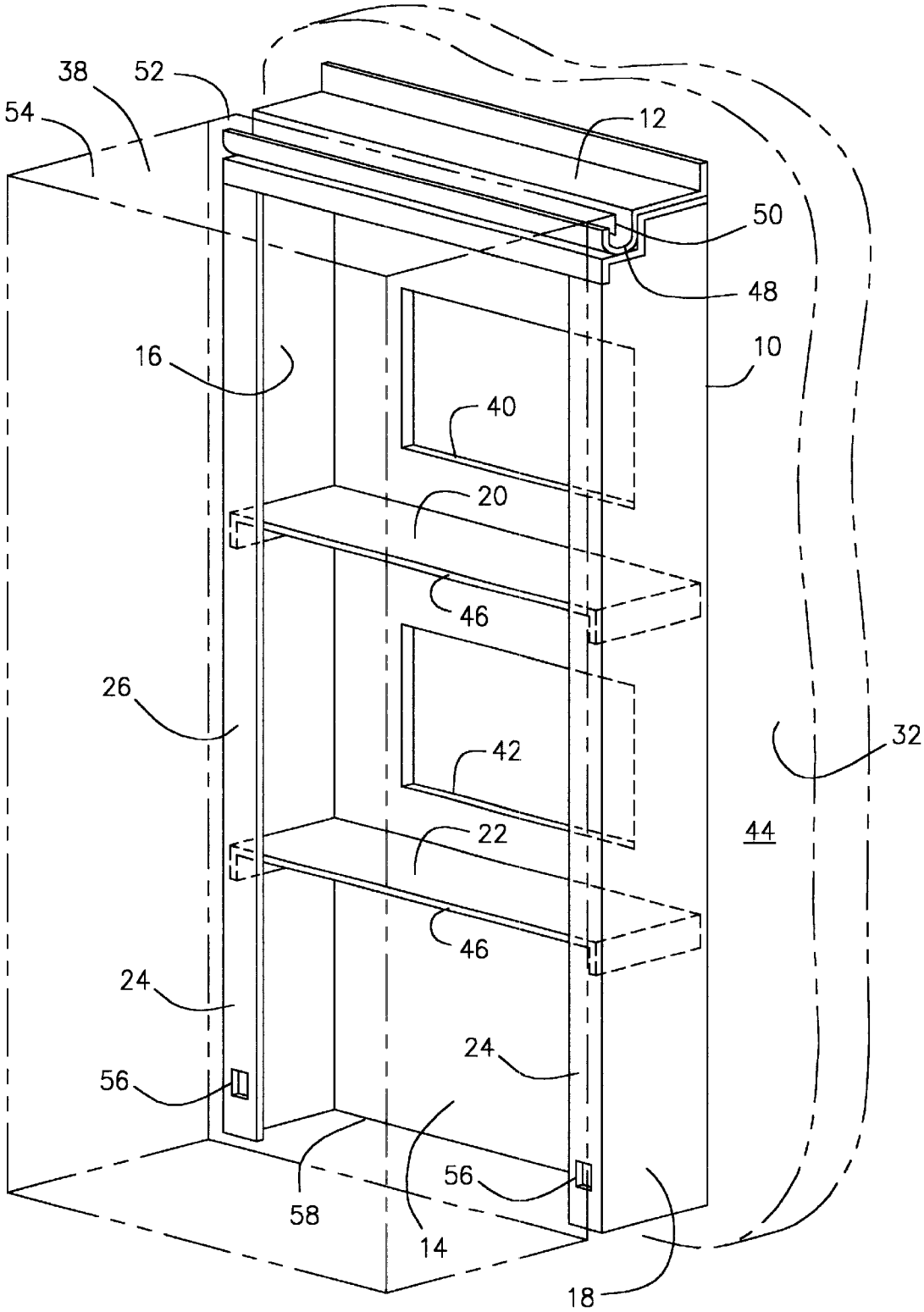
FIG. 1 is a perspective view of a first embodiment of the present invention with an exterior wall of a building shown to the right of the invention in outline and a HVAC shown to the left of the invention in outline.

Referring now to FIGS. 1, 2, 3 and 4 there is illustrated a wall curb 10 constructed in accordance with a first preferred embodiment of the present invention. As illustrated in FIG. 1, the wall curb 10 is provided with a top 12, a back wall 14, and two parallel side walls 16 and 18 that secure together at approximately right angles to each other. For the wall curb 10, two partitions 20 and 22 are provided within the wall curb 10. Each of the partitions 20 and 22 extends from the back wall 14 to a front edge 24 provided on the front 26 of the wall curb 10 at the top 12 and along each side wall 16 and 18. The first partition 20 of the two partitions 20 and 22 is spaced apart from the top 12 to define a supply air passageway 28 formed by the two side walls 16 and 18, the top 12, the back wall 14, and the first partition 20. The second partition 22 of the two partitions 20 and 22 is spaced apart from the first partition 20 to define a return air passageway 30 formed by the two side walls 16 and 18, the back wall 14, and the first and second partitions 20 and 22.

Figure 3:
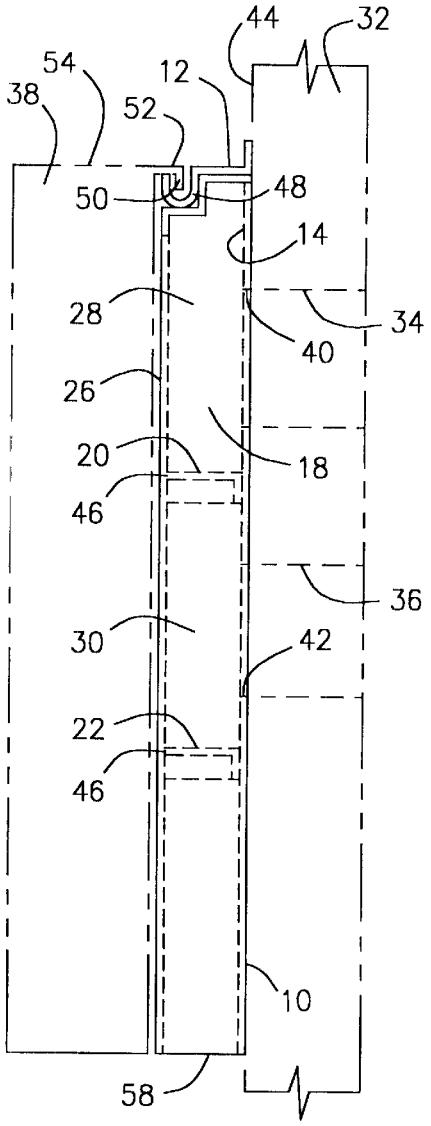
FIG. 3 is a right side view of the invention of FIG. 2 taken along line 3—3.

As shown in FIG. 3, the wall curb 10 permanently secures to an exterior wall 32 of a building so that the wall curb 10 secures over the supply air duct 34 emanating from within the building and secures over the return air duct 36 also emanating from within the building for the purpose of providing a fast, easy and removable way of connecting a wall mounted HVAC system together, i.e. connecting a HVAC unit 38 to a building's supply air and return air ducts 34 and 36.

Before the wall curb 10 is secured to the wall 32, the back wall 14 of the wall curb 10 is solid and must be cut to provide two openings 40 and 42 therethrough, i.e. a first wall curb opening 40 to which attaches the supply air duct 34 from the building and a second wall curb opening 42 to which attaches the return air duct 36 from the building. It is preferable to cut the two wall curb openings 40 and 42 in the back wall 14 at the installation site so that the wall curb openings 40 and 42 can be created in the proper shape and size to match, respectively, the shape and size of the corresponding supply air and return air ducts 34 and 36 emanating from the building. Properly cut wall curb openings 40 and 42 allow the installer to make a good, air tight fit of the wall curb 10 with the supply air and return air ducts 34 and 36.

Figure 4:
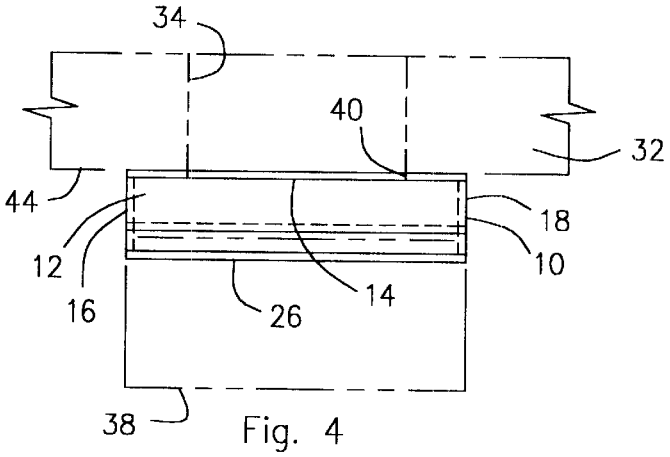
FIG. 4 is a top view of the invention of FIG. 2 taken along line 4—4.
Figure 2:
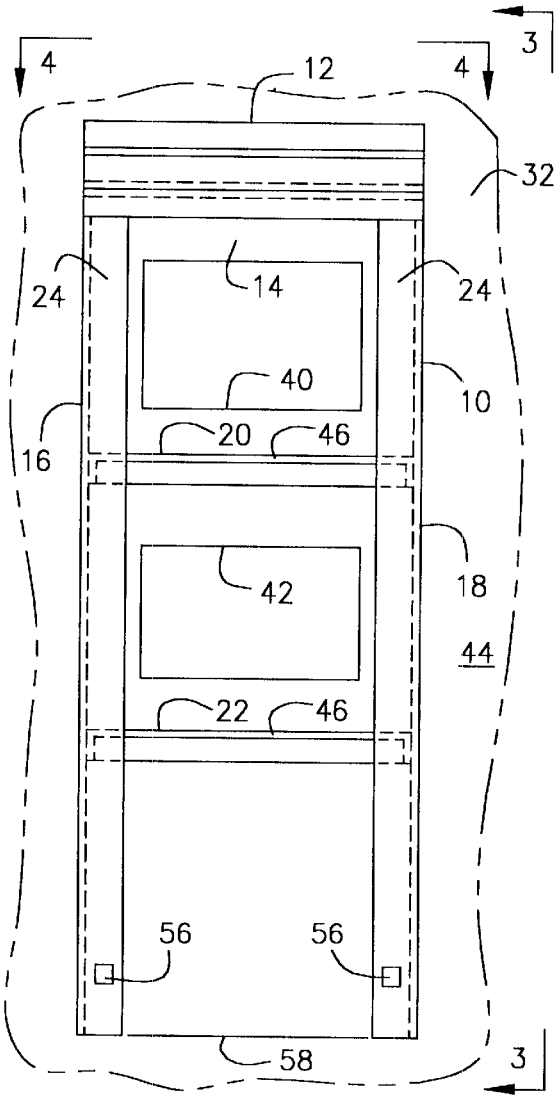
FIG. 2 is a front view of the invention of FIG. 1 shown attached to a wall.

As illustrated in FIGS. 2, 3, and 4, once the two wall curb openings 34and 36 have been cut into the back wall 14 of the wall curb 10, the back wall 14 of the wall curb 10 is then secured to an exterior surface 44 of the exterior wall 32 of the building. Although not illustrated, the wall curb 10 secures to the exterior surface of the wall with screws or other suitable fastening devices that extend through the back wall 14 of the wall curb 10 and into the supporting studs located within the exterior wall 32 of the building. The wall curb 10 is secured onto the wall 32 so that the two previously cut wall curb openings 40 and 42 align, respectively, with the supply air duct 34 and the return air duct 36 from within the building. The supply air duct 34 is fastened to the first wall curb opening 40 in the back wall 14 with suitable fastening devices and are taped together or otherwise secured to make an air tight seal between the supply air duct 34 and the supply air passageway 28 provided within the wall curb 10. Likewise, the return air duct 36 is fastened to the second wall curb opening 42 in the back wall 14 with suitable fastening devices and are taped together or otherwise secured to make an air tight seal between the return air duct 36 and the return air passageway 30 provided within the wall curb 10.

Although not illustrated, before the HVAC unit 38 is secured to the wall curb 10, some type of sealant or sealing gasket is applied to the front edge 24 of the wall curb 10 and a front edge 46 of each partition 20 and 22 located within the wall curb 10 so that when the HVAC unit 38 is secured to the wall curb 10, an airtight seal is formed between a return air opening (not illustrated) provided on the HVAC unit 38 and the return air passageway 30 in the wall curb 10, and also an airtight seal is form between a supply air opening (not illustrated) provided on the HVAC unit 38 and the supply air passageway 28 in the wall curb 10.

Next, the HVAC unit 38 is removably secured to the wall curb 10. As best illustrated in FIG. 3, an upwardly extending U-shaped lip 48 is provided along the front edge 24 of the top 12 of the wall curb 10 to removably receive a downwardly extending lip 50 provided at the rear edge 52 of the top 54 of the HVAC unit 38. Once the downwardly extending lip 50 of the HVAC unit 38 is received in the upwardly extending lip 48 of the wall curb 10, the lip 48 of the wall curb 10 supports the HVAC unit 38 and the HVAC unit 38 hangs from the lip 48 of the wall curb 10. Bolt openings 56 are provided in the front edge 24 near the bottom 10 of the wall curb 10 to accommodate cage nuts (not illustrated) as a means of securing the HVAC unit 38 to the wall curb 10 after the HVAC unit 38 has been hung on the upwardly extending lip 48 of the wall curb 10. The installer inserts bolts (not illustrated) through the HVAC unit 38 to engage the cage nuts (not illustrated) that are attached to the bolt openings 56 of the wall curb 10 as the final step in removably securing the HVAC unit 38 to the wall curb 10.

The first partition 20 within the wall curb 10 separates the supply air passageway 28 from the return air passageway 30 so when the HVAC unit 38 is secured and sealed to the front edge 24 of the wall curb 10 and the appropriate front edges 46 of the partitions 20 and 22, the supply air passageway 28 seals to the supply air opening (not illustrated) provided on the HVAC unit 38 and the return air passageway 30 seals to the return air opening (not illustrated) provided on the HVAC unit 38. When the HVAC unit 38 is thus sealed to the wall curb 10, there is airtight communication between the supply air duct 34, through the supply air passageway 28 of the wall curb 10, and into the supply air opening (not illustrated) on the HVAC 38. Likewise, when the HVAC unit 38 is sealed to the first embodiment wall curb 10, there is airtight communication between the return air duct 36, through the return air passageway 30, and into the return air opening (not illustrated) of the HVAC 38.

Figure 5:
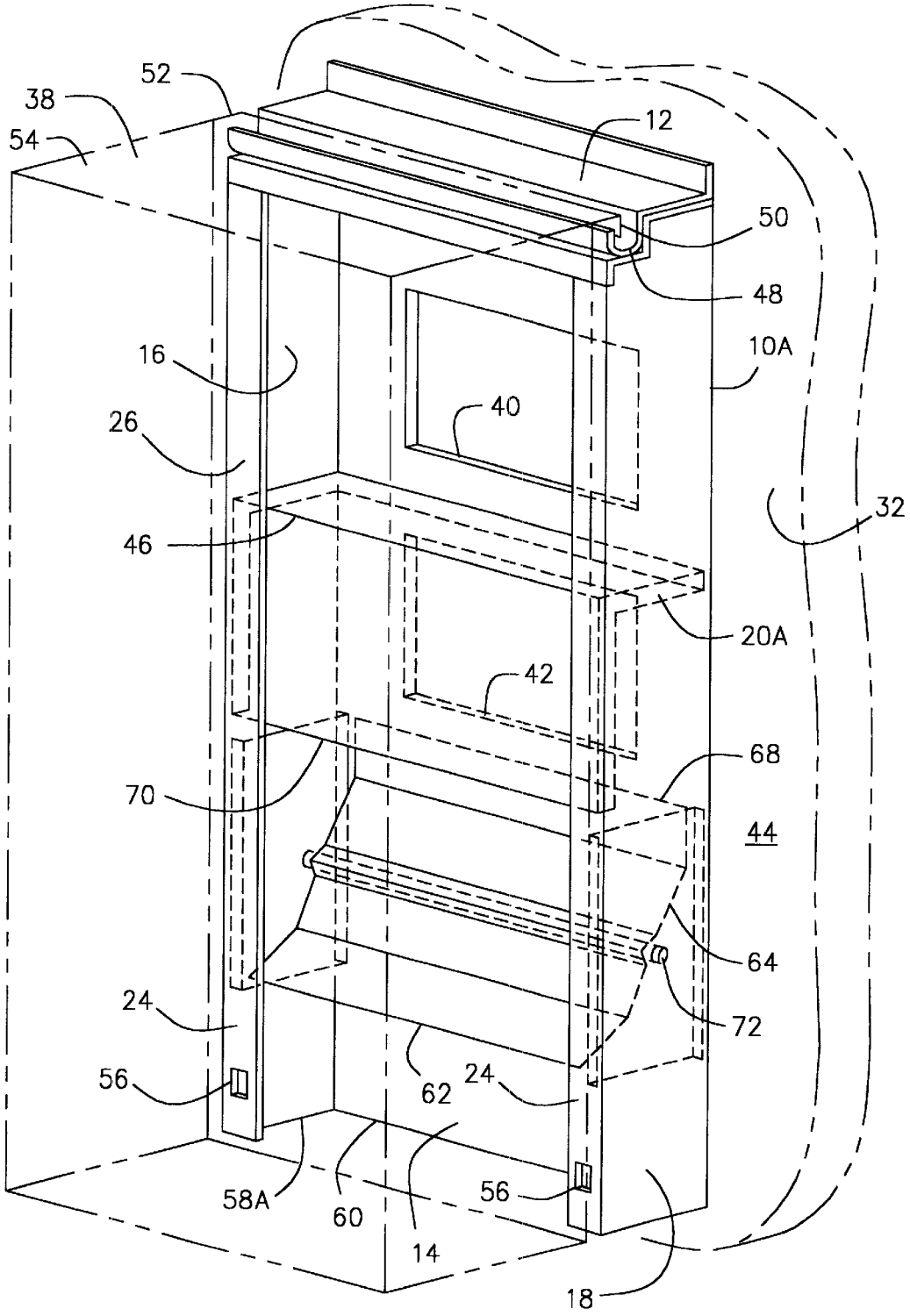
FIG. 5 is a perspective view of a second embodiment of the present invention with an exterior wall shown to the right of the invention in outline and a HVAC shown to the left of the invention in outline.
Figure 7:
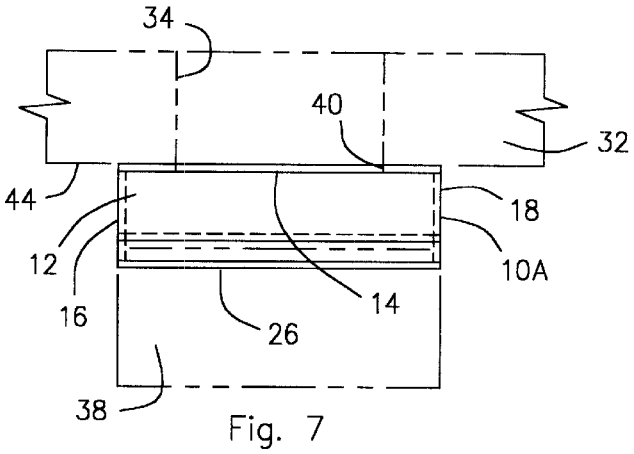
FIG. 7 is a top view of the invention of FIG. 6 taken along line 7—7.
Figure 6:
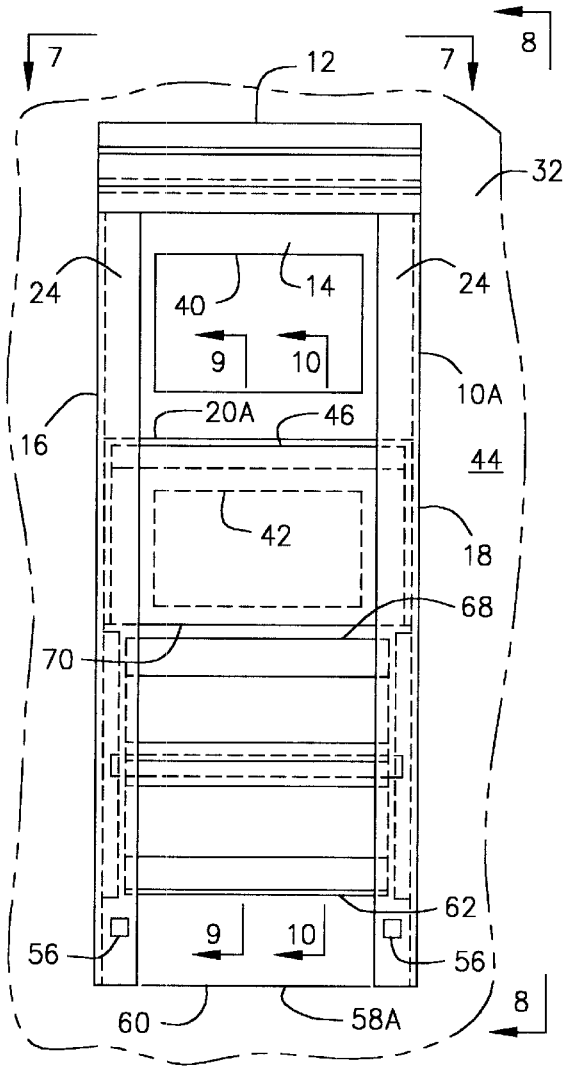
FIG. 6 is a front view of the invention of FIG. 5 shown attached to a wall.
Figure 8:
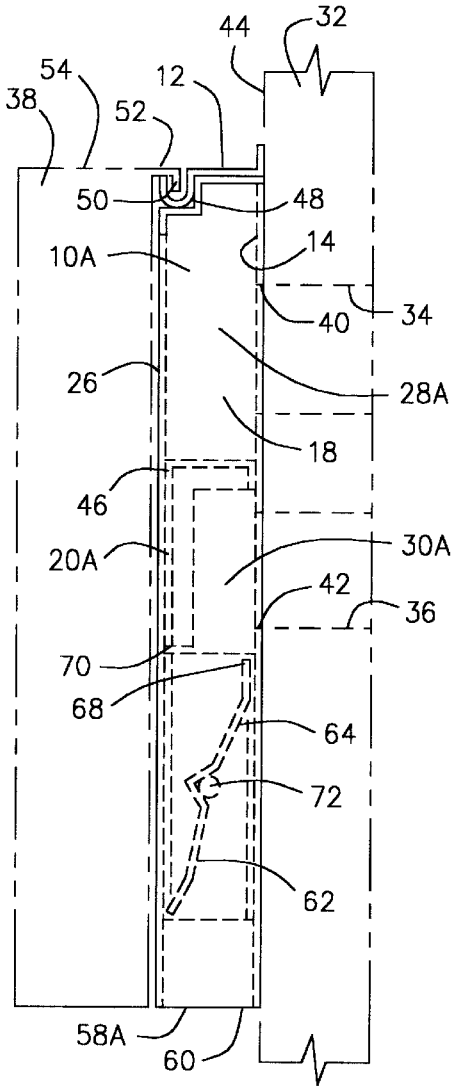
FIG. 8 is a right side view of the invention of FIG. 6 taken along line 8—8.
Figure 11:
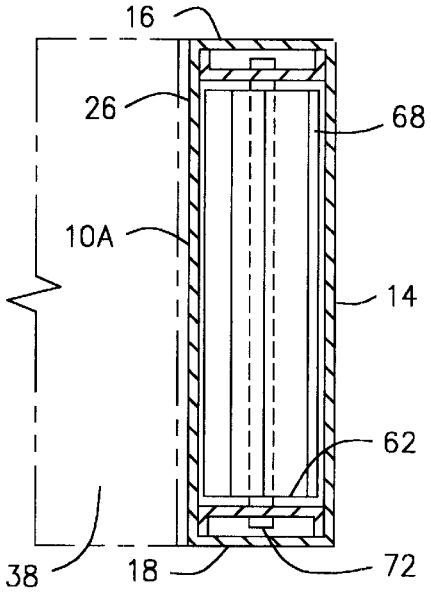
FIG. 11 is a cross section view taken along line 11—11 of FIG. 9 showing the damper in a position for admitting only return air into the HVAC unit.

Referring now to FIGS. 5–11, an alternate second preferred embodiment 10A of the present invention is illustrated. As best illustrated in FIG. 5, the alternate embodiment 10A differs from the first embodiment 10 in that the alternate embodiment 10A has an outside air opening 60 provided at the bottom 58A of the alternate wall curb 10A that communicates with the outside air. Because the outside air opening 60 is located at the bottom 58A of the alternate wall curb 10A, it is preferred that when the alternate wall curb 10A is installed on the exterior surface 44 of the wall 32, that the bottom 58A of the alternate wall curb 10A be located above ground level so that air can freely enter the alternate wall curb 10A via the outside air opening 60. This is illustrated in FIG. 8.

Figure 9:
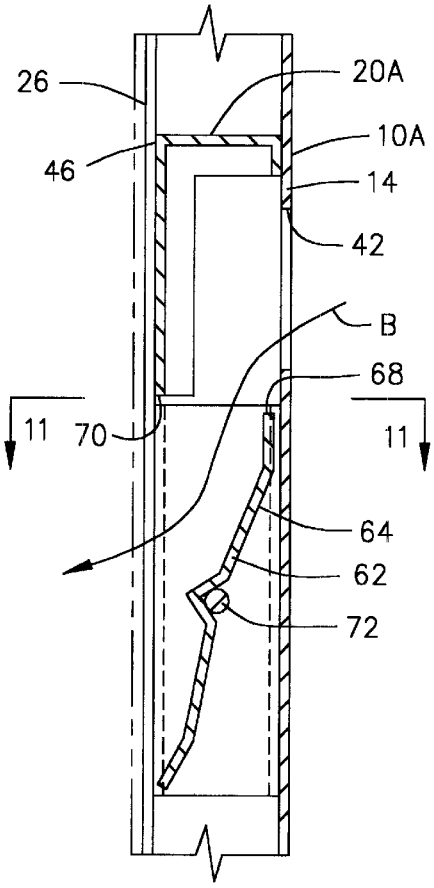
FIG. 9 is an enlarged cross sectional view of the damper of FIG. 6 taken along line 9—9 showing the damper in a position for admitting only return air into the HVAC unit.
Figure 10:
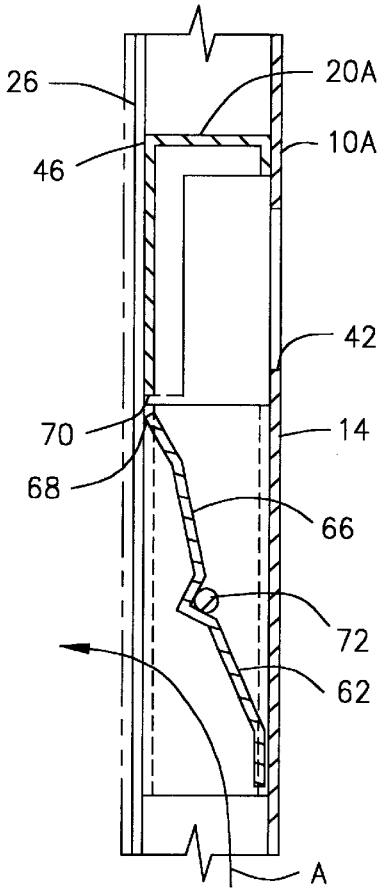
FIG. 10 is the damper of FIG. 9 shown in position for admitting only outside air into the HVAC unit.

Referring now to FIGS. 8, 9 and 10, the alternate embodiment 10A is provided with a controllable damper 62 that separates the outside air opening 60 from the return air passageway 30A. Because the alternate embodiment 10A contains this controllable damper 62, this requires a slight increase in the thickness of the alternate embodiment 10A as compared to the first embodiment 10 in order that the alternate embodiment 10A has sufficient depth to can accommodate the damper 62. This increase in thickness can be see by comparing FIGS. 3 and 8 and by comparing FIGS. 4 and 7.

The controllable damper 62 is used to regulate the ratio of return air, as indicated by Arrow A in FIG. 9, to outside air, as indicated by Arrow B in FIG. 10, flowing into the return air opening (not illustrated) of the HVAC unit 38. The damper 62 controls this ratio by moving between the positions 64 and 66, as illustrated in FIGS. 9 and 10. In FIG. 9, the damper 62 is located in its fully closed position 64 where no outside air is admitted to the HVAC unit 10A and only return air from the building is recirculated to the HVAC unit 10A. In FIG. 10, the damper 62 is located in its fully open position 66 where no return air from the building is recirculated to the HVAC unit 38 and only outside air is admitted to the HVAC unit 38.

The alternate wall curb 10A differs from the first embodiment 10 in one other way. Only one partition 20A is provided within the alternate wall curb 10A. This difference is best illustrated in FIGS. 5 and 8. The alternate wall curb 10A is provided with an inverted L-shaped partition 20A that extends from the back wall 14 of the alternate wall curb 10A to the front edges 24 of the alternate wall curb 10A and extends downward at the front 26 of the alternate wall curb 10A so that an upper edge 68 of the damper 62 is removably engagable with a lower leg 70 of the L-shaped partition 20A. The supply air passageway 28A of the alternate embodiment 10A is formed by the two side walls 16 and 18, the top 12, the back wall 14, and the L-shaped partition 20A. The return air passageway 30A for the alternate embodiment 10A is formed by the two side walls 16 and 18, the L-shaped partition 20A and the damper 62. The L-shaped partition 20A separates the supply air passageway 28 of the alternate embodiment 10A from the return air passageway 30 of the alternate embodiment 10A.

Referring now to FIGS. 9 and 10, the L-shaped partition 20A forces the air that is ultimately received by the air return opening (not illustrated) of the HVAC 38 to first flow past the damper 62, thereby allowing the damper 62 to control the ratio of air it receives from the return air duct 36 and from the outside air opening 60, i.e. the ratio of return air to outside air entering the HVAC unit 38. As shown also in FIG. 11, the damper 62 can be operated by rotating the damper 62 on its axis 72, thus moving or rotating the damper 62 between the fully closed and fully open positions 64 and 66 and through a plurality of positions lying intermediate between the fully closed and full open positions 64 and 66. To achieve this control of air, the damper 62 can be rotated on its axis 72 either manually or automatically, depending on the type of control mechanism attached to the axis 72.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A wall curb for removably securing a wall mounted HVAC unit to the return air and supply air ducts emanating from a building comprising:

a top secured approximately perpendicularly to two spaced apart parallel side walls, a back wall secured approximately perpendicularly to the two side walls and to the top, a front edge provided on both said two side walls and said top, a first partition provided between the side walls and extending from the back wall to said front edge, said first partition spaced apart from said top to form a supply air passageway with said top, said back wall, and said two side walls, said back wall provided with a supply air opening such that the supply air opening communicates with the supply air passageway and the supply air opening secures to a return air duct from within a building, the first partition forming a return air passageway with said back wall, and said two side walls, said back wall provided with a return air opening such that the return air opening communicates with the return air passageway and the return air opening secures to a return air duct from within a building, and means to removably secure a HVAC unit to said front edges, and means to secure said back wall to an exterior surface of a wall of a building at a location on the wall so that said back wall encompasses the return air and supply air ducts emanating from the building.

2. A wall curb according to claim 1 wherein said means to secure a HVAC unit to said front edges comprises:

an upwardly extending lip provided at the front edge of said top for removably engaging a downwardly extending lip provided at the top of the back of a HVAC unit.

3. A wall curb according to claim 2 wherein said means to secure a HVAC unit to said front edge further comprises:

bolts that engage cage nuts provided in cage nut openings at the bottom of the front edges of the side walls.

4. A wall curb according to claim 1 wherein said means to secure said back wall to an exterior surface of a wall of a building comprises:

fastening devices that extend through the back wall and engage the wall of a building.

5. A wall curb according to claim 1 further comprising:

a second partition provided between the walls and extending from the back wall to said front edge of the side walls, said second partition forming said return air passageway with said first partition, said back wall, and said two side walls.

6. A wall curb according to claim 1 further comprising:

a rotatable damper provided between said side walls for removable engagement with a lower portion of said second partition, said rotatable control damper communicating with said return air passageway and an outside air opening provided at the bottom of the side walls.

* * * * *